US011806768B2

(12) United States Patent
Tezuka

(10) Patent No.: US 11,806,768 B2
(45) Date of Patent: Nov. 7, 2023

(54) EDGE DROP CONTROL DEVICE

(71) Applicant: Toshiba Mitsubishi-Electric Industrial Systems Corporation, Tokyo (JP)

(72) Inventor: Tomoyuki Tezuka, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 427 days.

(21) Appl. No.: 17/231,020

(22) Filed: Apr. 15, 2021

(65) Prior Publication Data

US 2022/0088657 A1 Mar. 24, 2022

(30) Foreign Application Priority Data

Sep. 18, 2020 (JP) ..... 2020-157755

(51) Int. Cl.
*B21B 37/58* (2006.01)

(52) U.S. Cl.
CPC ..... *B21B 37/58* (2013.01)

(58) Field of Classification Search
CPC ..... B21B 37/58; B21B 37/42
See application file for complete search history.

(56) References Cited

U.S. PATENT DOCUMENTS 6,220,068 B1 * 4/2001 Brustle ..... B21B 37/28 72/11.8
2005/0016242 A1 * 1/2005 Kurahashi ..... B21B 45/0233 72/234
2011/0239722 A1 * 10/2011 Gruss ..... B21B 37/46 700/151

FOREIGN PATENT DOCUMENTS

IN 195120 B * 1/2005 ..... B21B 37/28
JP 60-12213 A 1/1985
JP H09-206814 A * 8/1997 ..... B21B 37/42
JP 2002-126811 A 5/2002

* cited by examiner

*Primary Examiner* — Kidest Bahta
(74) *Attorney, Agent, or Firm* — XSENSUS LLP

(57) ABSTRACT

An edge drop control device calculates a first calculated manipulated amount of a work roll shift device for bringing a difference between a measured edge drop amount and a target amount close to zero without using a work roll bender device. The edge drop control device calculates a second calculated manipulated amount of the work roll bender device for bringing a difference between a measured edge drop amount and the target amount close to zero without using a work roll shift device. The edge drop control device outputs, when the first calculated manipulated amount is out of an allowable range, the second calculated manipulated amount to the work roll bender device and also outputs a difference between an amount that corresponds to the second calculated manipulated amount and the first calculated manipulated amount, to the work roll shift device.

5 Claims, 7 Drawing Sheets

EDGE DROP CONTROL DEVICE

CROSS-REFERENCE TO RELATED APPLICATION

The present application claims priority under 35 U.S.C. § 119 to Japanese Patent Application No. 2020-157755, filed Sep. 18, 2020. The contents of this application are incorporated herein by reference in their entirety.

TECHNICAL FIELD

The present disclosure relates to an edge drop control device in cold rolling.

BACKGROUND

The strip thickness in a width direction of a material (metal strip) to be rolled which has been cold-rolled is usually the greatest at the center in the width direction and gradually decreases toward edges thereof and sharply decreases at the edges. A sharp decrease in the strip thickness at the edges in the width direction is called an edge drop.

The edge drop significantly deteriorates the accuracy of the strip thickness in the width direction of the metal strip. When the edge drop is large enough to fall outside a product tolerance, parts of the edge drop need to be cut off, thereby deteriorating yield. Therefore, reduction of the edge drop has been conventionally desired.

Known actuators for controlling the edge drop include a work roll shift device, an intermediate roll shift device, a work roll bender device, an intermediate roll bender device, and a roll cross device. Methods for controlling the edge drop using one of them or a combination of some of them have been conventionally proposed.

Patent Literature 1 (JP 2002-126811 A) discloses a method for controlling the edge drop by using a high response actuator in setup and using a low response actuator in rolling.

Patent Literature 2 (JP S60-12213 A) discloses a method for controlling a work roll shift device and a roll bender device based on an edge drop amount measured on the delivery side of a final rolling stand.

SUMMARY

As for the method in Patent Literature 1, it is not sure whether the edge drop is finally within an allowable range. In addition, with the method in Patent Literature 1, control of the edge drop is performed by using a low response actuator in rolling and therefore, when the edge drop varies rapidly in acceleration or deceleration, or other condition change, the control may be delayed.

As for Patent Literature 2, it is common that a response of the work roll shift device is slow and a response of the work roll bender device is quick. The method in Patent Literature 2 controls the edge drop by manipulating them simultaneously. Therefore, when the manipulated amount of the work roll shift device is large, the control is accordingly delayed. In addition, without a work roll bender mechanism that allows independent manipulation on each of both a work side and a drive side, appropriate control may not be performed when different edge drop amounts are detected on both sides.

The present disclosure has been made in order to solve the above-mentioned problems. It is an object of the present disclosure to provide an edge drop control device that can appropriately control an edge drop while reducing a control delay even when the edge drop significantly varies due to changes in a rolling speed or the like.

In order to achieve the above object, an edge drop control device according to the present disclosure is configured as follows.

The edge drop control device includes low response actuators, a high response actuator, an edge drop meter, and a processor.

The low response actuators are provided in a rolling stand that rolls a strip. The low response actuators include a first low response actuator and a second low response actuator. The low response actuators make a different amount of change to each of roll gaps at both edges of the strip, according to a combination of the operation of the first low response actuator based on a correction manipulated amount A and the operation of the second low response actuator based on a correction manipulated amount B.

The high response actuator is provided in the rolling stand. The high response actuator is faster than the first low response actuator and the second low response actuator. The high response actuator makes the same amount of change to each of the roll gaps at both edges of the strip, based on a correction manipulated amount C.

The edge drop meter is provided at least either upstream or downstream of the rolling stand. The edge drop meter measures an edge drop amount at each of both edges of the strip.

The processor executes a program stored in a memory, thereby functioning as a low response actuator manipulated amount calculation unit, a high response actuator manipulated amount calculation unit, and a manipulated amount determination unit.

The low response actuator manipulated amount calculation unit calculates a calculated manipulated amount A_calc of the first low response actuator and a calculated manipulated amount B_calc of the second low response actuator for bringing a difference between the measured edge drop amount and a target amount close to zero without using the high response actuator.

The high response actuator manipulated amount calculation unit calculates a calculated manipulated amount C_calc of the high response actuator for bringing a difference between the measured edge drop amount and the target amount close to zero without using the low response actuators.

The manipulated amount determination unit executes, when a determination condition is established, processing (1) and (2) below.

(1) Outputs the calculated manipulated amount A_calc as the correction manipulated amount A to the first low response actuator.

(2) Outputs the calculated manipulated amount B_calc as the correction manipulated amount B to the second low response actuator.

The manipulated amount determination unit executes, when the determination condition is not established, at least processing (3) below. Preferably, the manipulated amount determination unit executes, when the determination condition is not established, processing (3) to (5) below.

(3) Outputs the calculated manipulated amount C_calc as the correction manipulated amount C to the high response actuator.

(4) Outputs a difference between an amount that corresponds to the calculated manipulated amount C_calc and the calculated manipulated amount A_calc, as the correction manipulated amount A to the first low response actuator.

(5) Outputs a difference between an amount that corresponds to the calculated manipulated amount C_calc and the calculated manipulated amount B_calc, as the correction manipulated amount B to the second low response actuator.

In one aspect, the determination condition is established when the calculated manipulated amount A_calc and the calculated manipulated amount B_calc are within an allowable range.

In another aspect, the determination condition is established when the amount of change per unit time of the rolling speed of the rolling stand is within an allowable range.

In still another aspect, the edge drop control device includes a memory.

The memory stores, in advance, a control map in which a relation between the rolling speed of the rolling stand and a regulated manipulated amount C_reg of the high response actuator is defined. The regulated manipulated amount C_reg represents the manipulated amount of the high response actuator that does not cause a change in the edge drop amount of the strip at rolling speed change.

In addition, the high response actuator manipulated amount calculation unit obtains the regulated manipulated amount C_reg related to the rolling speed from the control map and outputs a difference from the previous obtained value as the calculated manipulated amount C_calc to the manipulated amount calculation unit.

The determination condition is established when the amount of change per unit time of the rolling speed is within an allowable range.

The manipulated amount determination unit executes, when the determination condition is not established, processing (3) in addition to processing (1) and (2) described above.

According to the present disclosure, even when the edge drop significantly changes due to, for example, changes in the rolling speed, the edge drop can be appropriately controlled while a control delay is reduced. Thus, the edge drop can be reduced throughout the length of the strip. As a result, the amount of cut-off of strip edges can be reduced, thereby improving yield.

DESCRIPTION OF EMBODIMENTS

Figure 1:
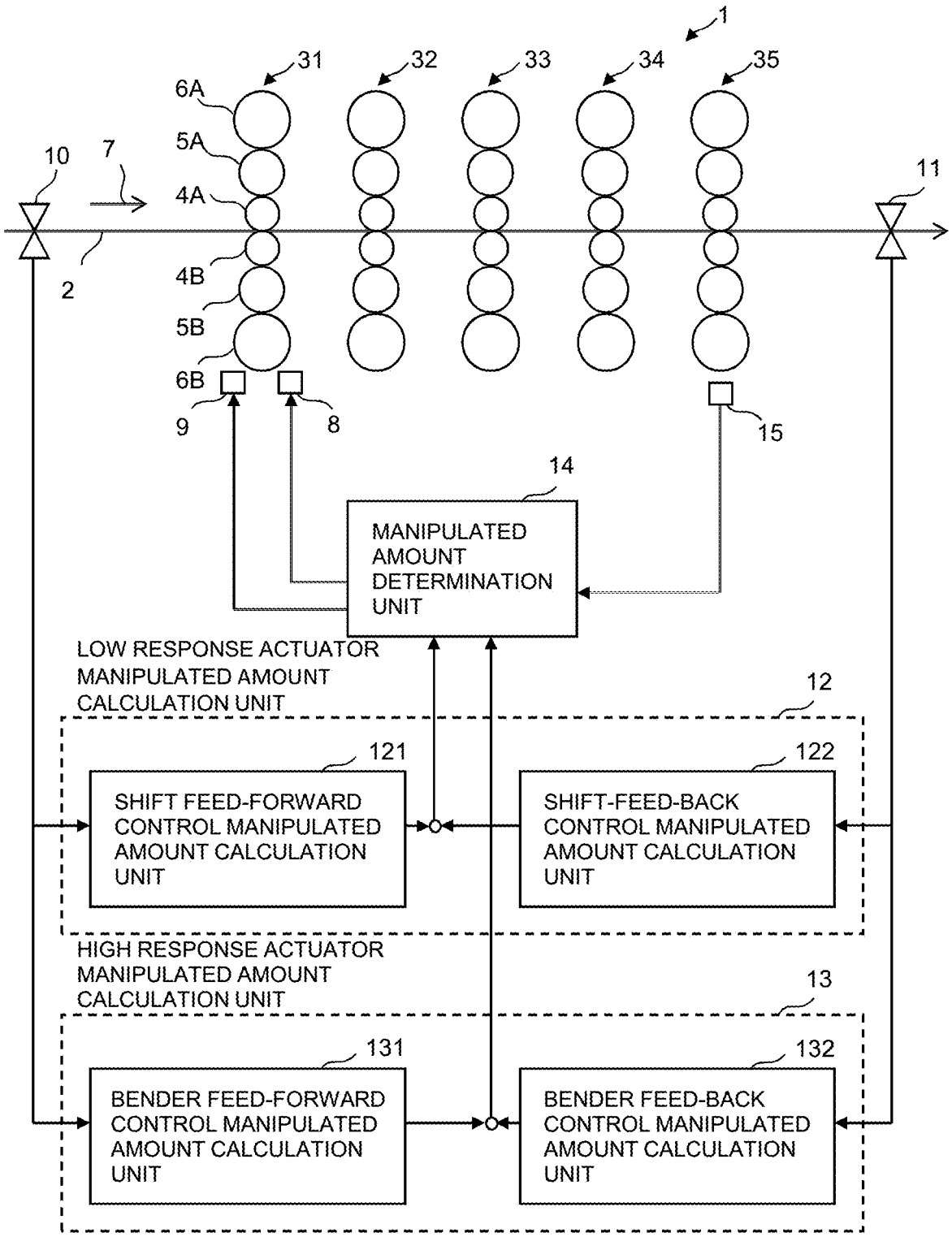
FIG. 1 is a block diagram showing the overall configuration of an edge drop control device included in a rolling system according to the first embodiment.

Hereinafter, embodiments of the present disclosure will be described in detail with reference to drawings. However, when numbers such as the number, quantity, volume, or range of elements are referred to in the embodiments presented below, the present disclosure is not limited by the numbers referred to except where especially explicitly specified and where clearly specified to the numbers in principle. In addition, structures and the like that are described in the embodiments presented below are not necessarily required for this disclosure except where especially explicitly specified and where clearly specified thereto in principle. Note that common elements in the drawings are denoted by the same reference signs to omit redundant explanations.

First Embodiment

<Overall Configuration>

FIG. 1 is a block diagram showing the overall configuration of an edge drop control device included in a rolling system according to the first embodiment of the present disclosure.

The rolling system illustrated in FIG. 1 includes a tandem cold rolling mill 1. The tandem cold rolling mill 1 is configured by arranging a plurality of rolling stands in series. The tandem cold rolling mill 1 continuously rolls a strip 2 that is a material to be rolled toward a right direction (arrow 7) in FIG. 1.

In FIG. 1, five rolling stands (a first rolling stand 31, a second rolling stand 32, a third rolling stand 33, a fourth rolling stand 34, a fifth rolling stand 35) are illustrated. The configuration of each of the rolling stands is a so-called 6 Hi configuration. Each of the rolling stands includes a pair of work rolls (WR), a pair of intermediate rolls (IMR), and a pair of backup rolls (BUR).

The first rolling stand 31 will be described as one example. An upper work roll 4A and a lower work roll 4B directly roll the strip 2. An upper intermediate roll 5A supports the upper work roll 4A. A lower intermediate roll 5B supports the lower work roll 4B. An upper backup roll 6A supports an upper intermediate roll 5A. A lower backup roll 6B supports the lower intermediate roll 5B.

In addition, the first rolling stand 31 includes a work roll shift device 8 and a work roll bender device 9.

Figure 2:
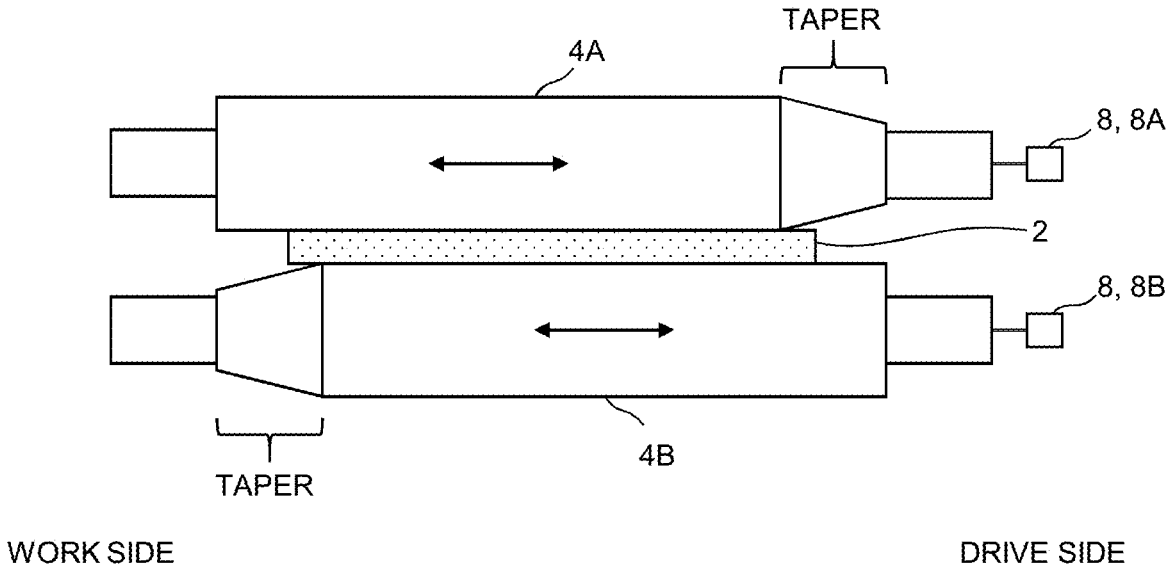
FIG. 2 is an illustration for describing work roll shapes and a work roll shift device.

FIG. 2 is an illustration for describing work roll shapes and the work roll shift device 8. The upper work roll 4A is a so-called taper work roll in which a one-side roll barrel part has been tapered by grinding. The lower work roll 4B is also a taper work roll. The upper work roll 4A and the lower work roll 4B are arranged so that their respective tapered parts are positioned in horizontally opposite positions. In an example illustrated in FIG. 2, the tapered part of the upper work roll 4A is positioned at drive side (DS) and the tapered part of the lower work roll 4B is positioned at work side (WS).

The work roll shift device 8 includes an upper work roll shift device 8A and a lower work roll shift device 8B. The upper work roll shift device 8A shifts the upper work roll 4A to a roll axis direction. The lower work roll shift device 8B shifts the lower work roll 4B to a roll axis direction. Thus, the work roll shift device 8 causes the upper work roll 4A and the lower work roll 4B to independently operate, so that a different amount of change can be made to roll gap at each of edges the strip 2.

Figure 3:
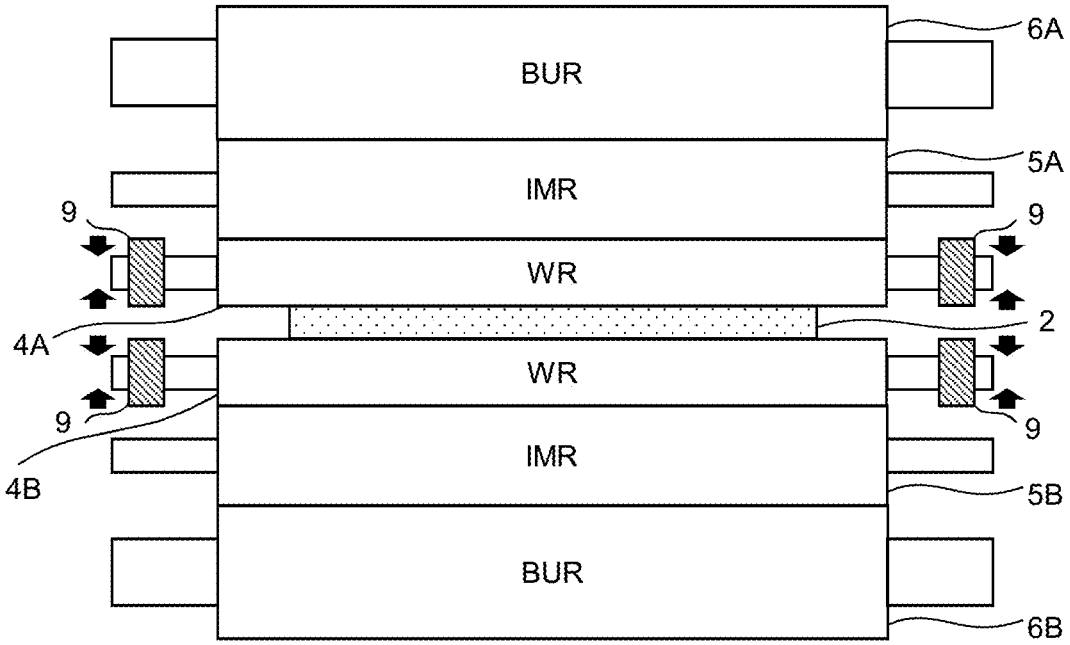
FIG. 3 is an illustration for describing a work roll bender device.

FIG. 3 is an illustration for describing the work roll bender device 9. The work roll bender device 9 includes a hydraulic cylinder for applying a bending force to both axial ends of each of the work rolls.

<Edge Drop Control Device>

Next, the edge drop control device will be described. The edge drop control device includes low response actuators, a high response actuator, an edge drop meter, a low response actuator manipulated amount calculation unit, a high response actuator manipulated amount calculation unit, and a manipulated amount determination unit.

(Low Response Actuators and High Response Actuator)

The low response actuators are provided in a rolling stand that rolls the strip 2. The low response actuators include a first low response actuator and a second low response actuator.

In the first embodiment, the low response actuators are the work roll shift device 8. The first low response actuator is the upper work roll shift device 8A. The second low response actuator is the lower work roll shift device 8B.

The high response actuator is provided in the rolling stand. The high response actuator is faster than the first low response actuator and the second low response actuator.

In the first embodiment, the high response actuator is the work roll bender device 9.

Each of the low response actuators and high response actuator is operated based on a manipulated amount which is obtained by adding a correction manipulated amount for controlling an edge drop to the manipulated amount which is preset according to product specifications. The operation based on the correction manipulated amount is described in the following. Note that a manipulated amount herein refers to a change amount between the previous control timing and the present control timing for each actuator.

The work roll shift device 8 (low response actuators) makes a different amount of change to each of roll gaps at the edges of the strip 2, according to a combination of the operation of the upper work roll shift device 8A (first low response actuator) based on a correction manipulated amount A and the operation of the lower work roll shift device 8B (second low response actuator) based on a correction manipulated amount B.

The work roll bender device 9 (high response actuator) makes the same amount of change to each of the roll gaps at the edges of the strip 2, based on a correction manipulated amount C.

(Edge Drop Meter)

An entry side edge drop meter 10 is provided at an entry side of the first rolling stand 31. A delivery side edge drop meter 11 is provided at a delivery side of the fifth rolling stand 35. The entry side edge drop meter 10 and the delivery side edge drop meter 11 measure an edge drop amount of each of the edges of the strip 2.

Here, the edge drop will be briefly described. The edge drop is a sharp decrease in a strip thickness at the edges of the strip 2. The edge drop is defined as a strip thickness difference between two points in the width direction of the strip 2, by the following expression.

[Math. 1]

$$ED = h_{x1} - h_{x2} \quad (1)$$

Where,

ED: edge drop amount [μm]

$h_{x1}$: strip thickness [μm] at a point X1 [mm] from the strip edge $h_{x2}$: strip thickness [μm] at a point X2 [mm] from the strip edge (X1>X2)

X1 is typically a value close to 100 [mm] or a value indicating the center in the strip width direction. X2 is a value of 10 to 25 [mm].

A larger edge drop causes an increase in the amount of cut-off in the edge parts that do not satisfy a product quality, resulting in a decrease in yield. Thus, in order to satisfy the product quality, feed-forward control, feedback control, and the like are performed.

Next, the edge drop control in the first embodiment will be described.

(Low Response Actuator Manipulated Amount Calculation unit)

A low response actuator manipulated amount calculation unit 12 calculates a calculated manipulated amount A_calc of the upper work roll shift device 8A (first low response actuator) and a calculated manipulated amount B_calc of the lower work roll shift device 8B (second low response actuator) for bringing a difference between the measured edge drop amount and a target amount close to zero without using the work roll bender device 9 (high response actuator).

Specifically, the entry side edge drop meter 10 measures an edge drop amount at each of the edges (work side and drive side) of the strip 2. A shift feed-forward control manipulated amount calculation unit 121 calculates, based on those edge drop amounts, a calculated manipulated amount A_calc_FF of the upper work roll shift device 8A and a calculated manipulated amount B_calc_FF of the lower work roll shift device 8B.

In addition, the delivery side edge drop meter 11 measures an edge drop amount at each of the edges (work side and drive side) of the strip 2. A shift feed-back control manipulated amount calculation unit 122 calculates, based on those edge drop amounts, a calculated manipulated amount A_calc_FB of the upper work roll shift device 8A and a calculated manipulated amount B_calc_FB of the lower work roll shift device 8B.

The low response actuator manipulated amount calculation unit 12 outputs, as a calculated manipulated amount A_calc of the upper work roll shift device 8A, a manipulated amount that is obtained by adding together the calculated manipulated amount A_calc_FF of the feed-forward control and the calculated manipulated amount A_calc_FB of the feed-back control, to a manipulated amount determination unit 14.

In addition, the low response actuator manipulated amount calculation unit 12 outputs, as a calculated manipulated amount B_calc of the lower work roll shift device 8B, a manipulated amount that is obtained by adding together the calculated manipulated amount B_calc_FF of the feed-forward control and the calculated manipulated amount B_calc_FB of the feed-back control, to the manipulated amount determination unit 14.

The calculated manipulated amount of the feed-forward control and the calculated manipulated amount of the feed-back control, which are described above, can be calculated by using any of known methods. The calculated manipulated amount represents a change amount between the previous control timing and the present control timing.

(High Response Actuator Manipulated Amount Calculation Unit)

The high response actuator manipulated amount calculation unit 13 calculates a calculated manipulated amount C_calc of the work roll bender device 9 (high response actuator) for bringing a difference between the measured edge drop amount and a target amount to zero without using the work roll shift device 8 (low response actuators).

Specifically, the entry side edge drop meter 10 measures an edge drop amount at each of the edges (work side and drive side) of the strip 2. A bender feed-forward control manipulated amount calculation unit 131 calculates, based on an average value of those edge drop amounts, a calculated manipulated amount C_calc_FF of the work roll bender device 9.

In addition, the delivery side edge drop meter 11 measures an edge drop amount at each of the edges (work side and drive side) of the strip 2. A bender feed-back control manipulated amount calculation unit 132 calculates, based on an average value of those edge drop amounts, a calculated manipulated amount C_calc_FB of the work roll bender device 9.

The high response actuator manipulated amount calculation unit 13 outputs, as a calculated manipulated amount C_calc of the work roll bender device 9, a manipulated amount that is obtained by adding together the calculated manipulated amount C_calc_FF of the feed-forward control and the calculated manipulated amount C_calc_FB of the feed-back control, to the manipulated amount determination unit 14.

The calculated manipulated amount of the feed-forward control and the calculated manipulated amount of the feed-back control, which are described above, can be calculated by using any of known methods. The calculated manipulated amount represents a change amount between the previous control timing and the present control timing.

(Manipulated Amount Determination Unit)

The manipulated amount determination unit 14 determines the correction manipulated amount of each of the actuators, based on the calculated manipulated amount which is input from the low response actuator manipulated amount calculation unit 12 and the calculated manipulated amount which is input from the high response actuator manipulated amount calculation unit 13.

As described above, the work roll shift device 8 can make a different amount of change to each of the roll gaps at the edges of the strip 2, according to a combination of the operation of the upper work roll shift device 8A and the operation of the lower work roll shift device 8B. That is, the work roll shift device 8 can individually control each of the edge drops of the edges of the strip 2.

On the other hand, the work roll bender device 9 makes the same amount of change to each of the roll gaps at the edges of the strip 2, based on the correction manipulated amount C. Therefore, the work roll bender device 9 cannot individually control each of the edge drops of the edges of the strip 2.

Therefore, in order to control the edge drop, the work roll shift device 8 should be preferentially used. However, the response of the work roll shift is slow, which may cause a control delay.

To avoid this situation, a limit is set to a change amount between the previous control timing and the present control timing, and when a calculated manipulated amount of the work roll shift device 8 is within the range of the limit, the work roll shift device 8 is to be actively used.

Specifically, whether the calculated manipulated amount A_calc and the calculated manipulated amount B_calc are within an allowable range is used as a determination condition. When the determination condition is established, that is, when the calculated manipulated amount A_calc and the calculated manipulated amount B_calc are within the allowable range, the manipulated amount determination unit 14 executes processing (1) and (2) below.

(1) Outputs the calculated manipulated amount A_calc as a correction manipulated amount A to the upper work roll shift device 8A (first low response actuator).

(2) Outputs the calculated manipulated amount B_calc as a correction manipulated amount B to the lower work roll shift device 8B (second low response actuator).

In this case, the correction manipulated amount C is zero and the work roll bender device 9 (high response actuator) does not perform the edge drop control.

On the other hand, when the calculated manipulated amount of the work roll shift device 8 is out of the limit range, it is necessary that the work roll bender device 9 having a faster response than the work roll shift device 8 should perform the edge drop control. Therefore, the manipulated amount determination unit 14 executes, when the determination condition is not established, processing (3) described later.

As described above, the work roll bender device 9 exerts the same effect to the both edges and therefore, if there is a difference in the edge drop amount between both edges, it causes an error to remain.

Figure 4:
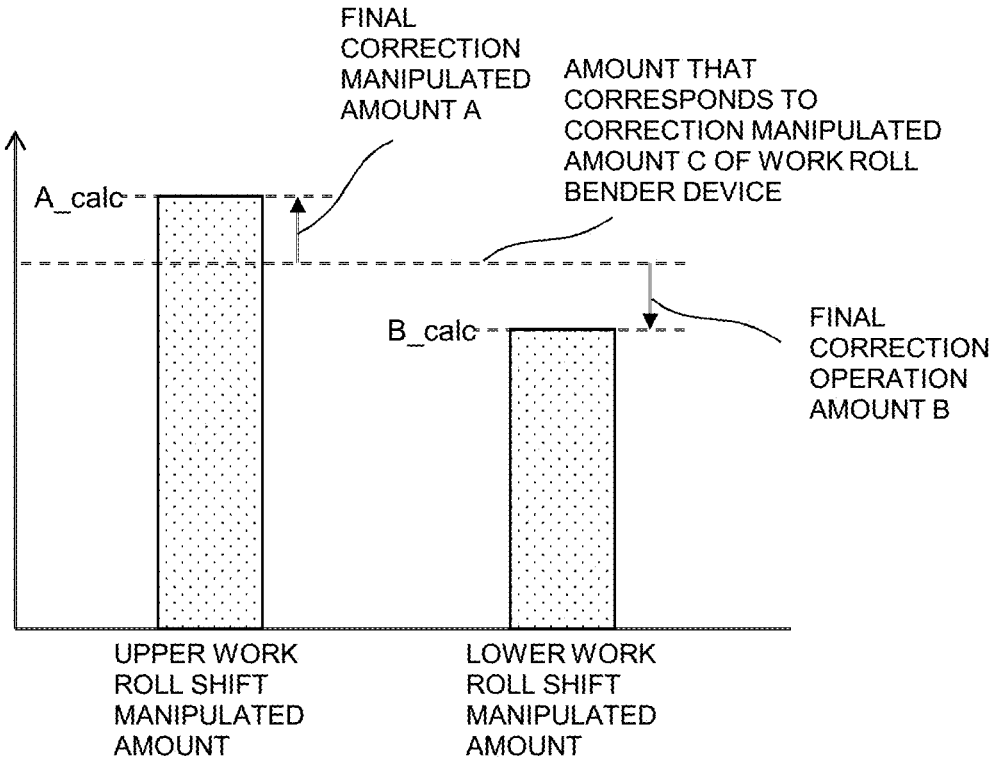
FIG. 4 is a graph showing a correction manipulated amount A of an upper work roll shift device and a correction manipulated amount B of a lower work roll shift device when determination condition is not established.

Therefore, as illustrated in FIG. 4, the upper work roll shift device 8A and the lower work roll shift device 8B are operated so that an edge drop which remains when the work roll bender device 9 is operated based on the calculated manipulated amount C_calc could be reduced. FIG. 4 is a graph showing the correction manipulated amount A of the upper work roll shift device 8A and the correction manipulated amount B of the lower work roll shift device 8B when the determination condition is not established.

Specifically, when the determination condition is not established, that is, when at least either the calculated manipulated amount A_calc or the calculated manipulated amount B_calc is out of the allowable range, the manipulated amount determination unit 14 executes processing (3) to (5) below.

(3) Outputs the calculated manipulated amount C_calc as the correction manipulated amount C to the work roll bender device 9 (high response actuator).

(4) Outputs a difference between an amount that corresponds to the calculated manipulated amount C_calc and the calculated manipulated amount A_calc as the correction manipulated amount A to the upper work roll shift device 8A (first low response actuator).

(5) Outputs a difference between an amount that corresponds to the calculated manipulated amount C_calc and the calculated manipulated amount B_calc as the correction manipulated amount B to the lower work roll shift device 8B (second low response actuator).

Here, the amount that corresponds to the calculated manipulated amount C_calc is the manipulated amount of the work roll shift device 8 which corresponds to an edge drop amount that changes when the work roll bender device 9 is operated with the calculated manipulated amount C_calc. The amount that corresponds to the calculated manipulated amount C_calc is represented by the following formula (2).

[Math. 2]

$$\Delta L=(\partial L/\partial F_B)\cdot\Delta F_B \tag{2}$$

Where $\Delta T$: Work roll shift change amount [mm]

$\partial L/\partial F_B$: Conversion coefficient [mm/kN]

$\Delta F_B$: Work roll bender change amount [kN]

A relation between the work roll shift change amount and the work bender change amount is determined by experiment or simulation. A conversion coefficient based on this relation is stored in a memory 82 in FIG. 7 described later. Alternatively, the conversion coefficient may be sent from a host computer that determines, for each of materials to be rolled, information on the material to be rolled, setting values for the actuators, and the like.

A difference between ΔL calculated by the formula (2) and the calculated manipulated amount A_calc is set to be the correction manipulated amount A of the upper work roll shift device 8A at the present control timing. Similarly, a difference between ΔL and the calculated manipulated amount B_calc is set to be the correction manipulated amount B of the lower work roll shift device 8B at the present control timing.

As described above, the edge drop control device according to this embodiment can appropriately control an edge drop while reducing a control delay even when the edge drop significantly changes. Thus, the edge drop can be reduced throughout the length of the strip 2. As a result, the amount of cut-off of the both edges can be reduced, thereby improving yield.

<Modification>

In the system of the first embodiment described above, the determination condition is whether the calculated manipulated amount A_calc and calculated manipulated amount B_calc of the work roll shift are within an allowable range. However, the determination condition is not limited thereto. In many cases, the manipulated amount of the work roll shift device becomes large when the rolling speed changes. This is because a change in the rolling speed causes rolling conditions including tension and roll force to be changed, which affects the edge drop. Therefore, the determination condition may be whether the rolling speed is constant.

As one example, the edge drop control device includes a rolling speed meter 15 that measures the rolling speed of a rolling stand. The determination condition is whether the change amount per unit time of the measured rolling speed is within an allowable range. When the determination condition is established, that is, when the change amount per unit time of the measured rolling speed is within the allowable range, the manipulated amount determination unit 14 executes the above described processing (1) and (2). In addition, when the determination condition is not established, that is, when the change amount per unit time of the measured rolling speed is out of the allowable range, the manipulated amount determination unit 14 executes the above described processing (3) to (5).

As another example, a rolling speed reference to be input to a rolling stand may be used. That is, the determination condition is whether the change amount per unit time of the rolling speed reference for controlling the rolling stand is within an allowable range. When the determination condition is established, that is, when the change amount per unit time of the rolling speed reference is within the allowable range, the manipulated amount determination unit 14 executes the above described processing (1) and (2). In addition, when the determination condition is not established, that is, when the change amount per unit time of the rolling speed reference is out of the allowable range, the manipulated amount determination unit 14 executes the above described processing (3) to (5).

In the configurations described above, even when the edge drop significantly changes due to changes in the rolling speed, the edge drop can be effectively controlled.

It should be noted that the operation of the work roll bender affects not only the edge drop but also the shape of the strip 2. To prevent a shape defect, the manipulation range of the work roll bender device 9 for the edge drop control may be constrained.

In addition, although the system of the first embodiment described above includes two meters of the entry side edge drop meter 10 and the delivery side edge drop meter 11, it is acceptable to include only either of them. Furthermore, the system of the first embodiment may include an edge drop meter between stands. This point is the same in the embodiment below.

In addition, the system of the first embodiment described above has adopted a 6 Hi configuration for the rolling stand. However, the configuration of the rolling stand is not limited thereto. It is possible to adopt a 2 Hi configuration of only the upper work roll 4A and the lower work roll 4B, a 4 Hi configuration in which the upper and lower work rolls are supported by the upper and lower backup rolls, and other configurations. This point is the same in the embodiment below.

In addition, for the system of the first embodiment described above, its description has been made by using the work roll shift device and the work roll bender device as actuators that control the edge drop. However, actuators that control the edge drop are not limited thereto. As the first low response actuator, an intermediate roll shift device may be used which shifts the upper intermediate roll 5A to the roll axis direction and as the second low response actuator, a lower intermediate roll shift device that shifts the lower intermediate roll 5B to the roll axis direction may be used. Furthermore, as the high response actuator, an intermediate roll bender device may be used which applies a bending force to both axial ends of each of the intermediate rolls. Yet furthermore, as the high response actuator, a roll cross device may be used which makes the roll axes of the upper rolls 4A, 5A, 6A and the lower roll 4B, 5B, 6B cross each other, thereby allowing adjustment of roll gap. This point is the same in the embodiment below.

In addition, the system of the first embodiment described above applies the edge drop control to the first rolling stand 31; however it may be applied to other rolling stands. Furthermore, it may also be applied to a plurality of the rolling stands. This point is the same in the embodiment below.

In addition, in the system of the first embodiment described above, the entry side edge drop meter 10 does not necessarily need to be immediately close to the first rolling stand 31 and may be upstream of a facility attached to the entry side. In this case, it is only required that a measured edge drop amount be transmitted to each of the actuator manipulated amount calculation units before a corresponding position of the strip 2 where measurement has been performed reaches the entry side of the first rolling stand 31. This point is the same in the embodiment below.

In addition, rolling in the system of the first embodiment described above may be either batch rolling or continuous rolling. Furthermore, the edge drop control device is applicable to not only a tandem rolling mill including a plurality of rolling stands but also a single rolling mill. This point is the same in the embodiment below.

Second Embodiment

<Overall Configuration>

Next, the second embodiment of the present disclosure will be described with reference to FIG. 5 and FIG. 6.

Figure 5:
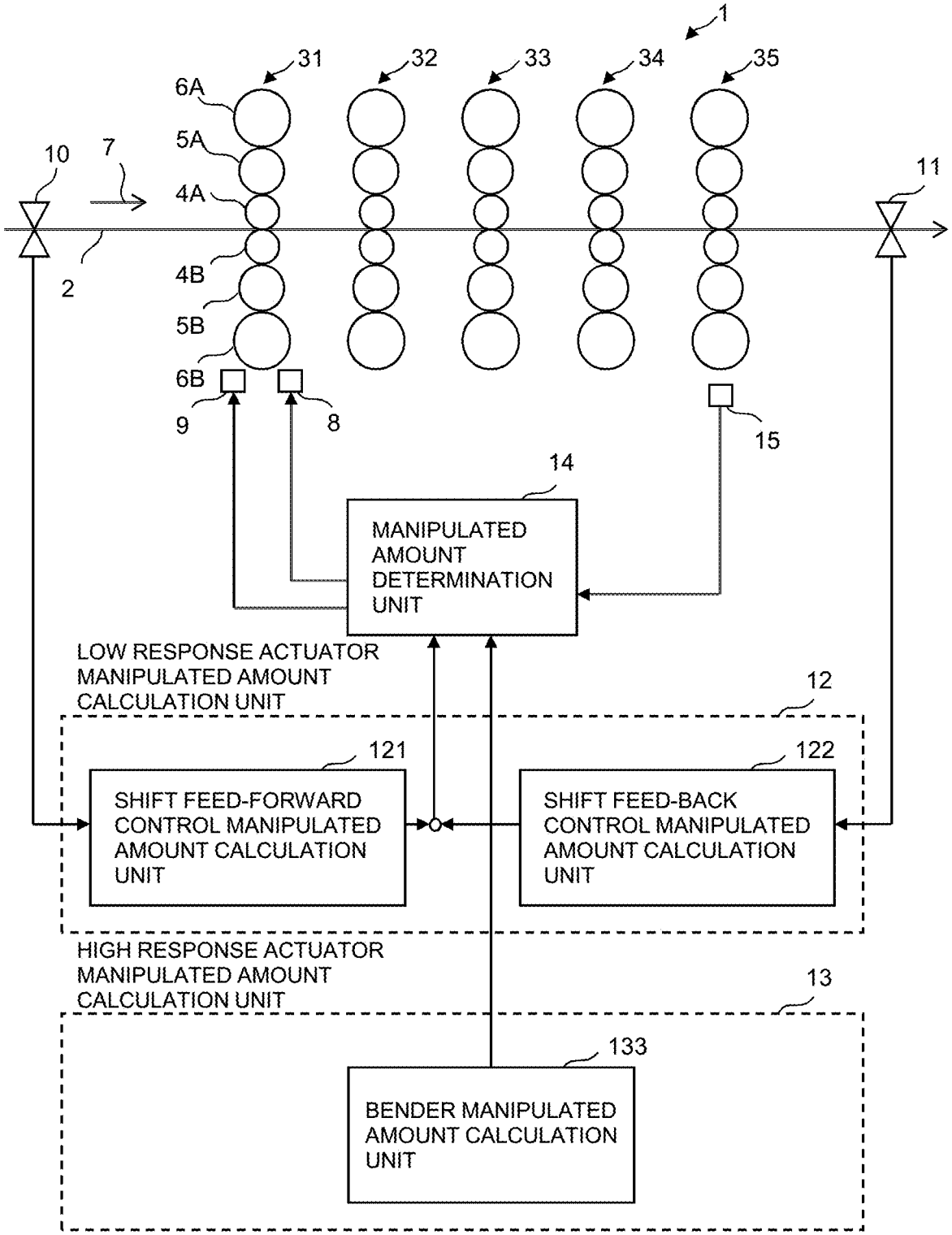
FIG. 5 is a block diagram showing the overall configuration of an edge drop control device included in a rolling system according to the second embodiment.

FIG. 5 is a block diagram showing the overall configuration of an edge drop control device included in a rolling system according to the second embodiment of the present disclosure. The edge drop control device according to the second embodiment is the same as the first embodiment, for components other than the high response actuator manipulated amount calculation unit 13 and the rolling speed meter 15. Therefore, components different from those of the first embodiment will be mainly described.

The rolling speed meter 15 measures the rolling speed of at least one rolling stand. In an example of FIG. 5, the rolling speed meter 15 measures the roll rotation speed of the fifth rolling stand 35.

The high response actuator manipulated amount calculation unit 13 calculates a calculated manipulated amount C_calc of the high response actuator for bringing a difference between the measured edge drop amount and a target amount close to zero without using the low response actuators. In the second embodiment, the calculation method for the calculated manipulated amount C_calc is different from that of the first embodiment.

The memory 82 in FIG. 7 described later stores in advance a control map that defines a relation between the rolling speed of a rolling stand and a regulated manipulated amount C_reg of the work roll bender device 9 (high response actuator).

Here, the regulated manipulated amount C_reg represents the manipulated amount of the work roll bender device 9 which does not cause a change in the edge drop amount of the strip 2 at rolling speed change. A relation between the rolling speed and the regulated manipulated amount C_reg of the work roll bender device 9 is determined by experiment or simulation. This relation is stored as a control map, in the memory 82. Alternatively, a relation between the rolling speed and the regulated manipulated amount C_reg of the work roll bender device 9 may be sent from a host computer that determines, for each of materials to be rolled, information on the material to be rolled, setting values for each of the actuators, and the like.

Figure 6:
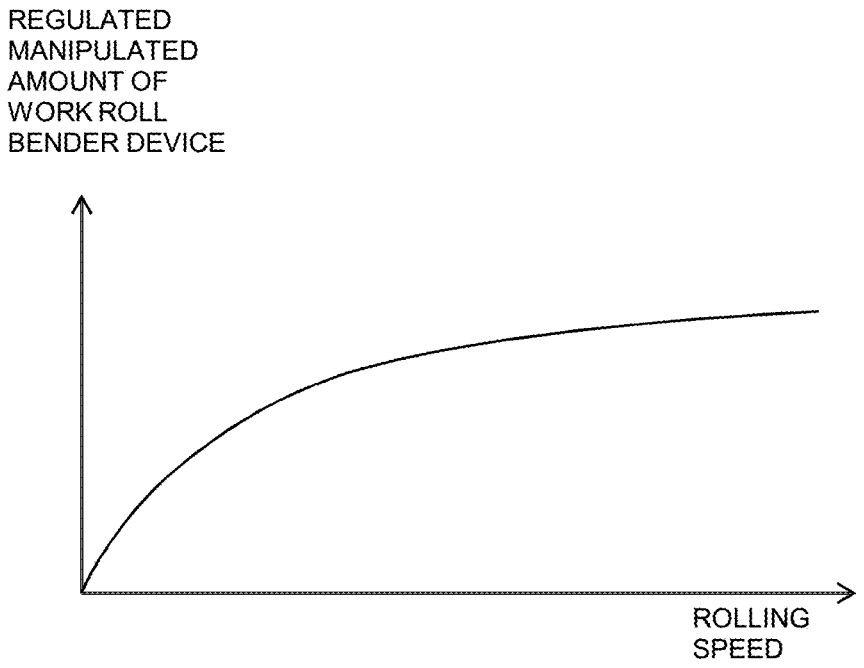
FIG. 6 is a control map of the edge drop control device included in the rolling system according to the second embodiment of the present disclosure.

FIG. 6 is a control map of the edge drop control device included in the rolling system according to the second embodiment of the present disclosure. For example, as shown in FIG. 6, the higher the rolling speed is, the larger the regulated manipulated amount C_reg of the work roll bender device 9 is.

A bender manipulated amount calculation unit 133 calculates a manipulated amount at the present control timing of the work roll bender device 9 in accordance with a rolling speed which is measured by the rolling speed meter 15. Specifically, the bender manipulated amount calculation unit 133 obtains, from the control map, a regulated manipulated amount C_reg corresponding to the rolling speed measured by the rolling speed meter 15; and outputs a difference from the previous obtained value as a calculated manipulated amount C_calc to the manipulated amount determination unit 14.

As with the first embodiment, to prevent a shape defect in consideration of an influence on the shape of the strip 2, the manipulation range of the work roll bender device 9 for the edge drop control may be constrained.

In the second embodiment, the determination condition is whether the change amount per unit time of the measured rolling speed is within an allowable range. The manipulated amount determination unit 14 executes, when the determination condition is established, the above described processing (1) and (2), as with the first embodiment. In addition, the manipulated amount determination unit 14 executes, when the determination condition is not established, processing (3) in addition to processing (1) and (2) described above.

As described above, the edge drop control device according to this embodiment can calculate in advance a manipulated amount in accordance with a rolling speed and output it, thereby allowing a stable edge drop control even when the rolling speed changes.

<Modification>

In the system of the second embodiment described above, the determination condition is whether the rolling speed is constant. As a specific example, a rolling speed that is measured by the rolling speed meter 15 is used as the determination condition; however it is not limited thereto. A rolling speed reference that is input to a rolling stand may be used as the determination condition. That is, the determination condition is whether the change amount per unit time of the rolling speed reference for controlling the rolling stand is within the allowable range. The bender manipulated amount calculation unit 133 obtains, from the control map, a regulated manipulated amount C_reg corresponding to the rolling speed reference; and outputs a difference from the previous obtained value as a calculated manipulated amount C_calc to the manipulated amount determination unit 14. The manipulated amount determination unit 14 executes, when the determination condition is established, processing (1) and (2) described above. In addition, the manipulated amount determination unit 14 executes, when the determination condition is not established, processing (3) in addition to processing (1) and (2) described above.

<Hardware Configuration Example>

Figure 7:
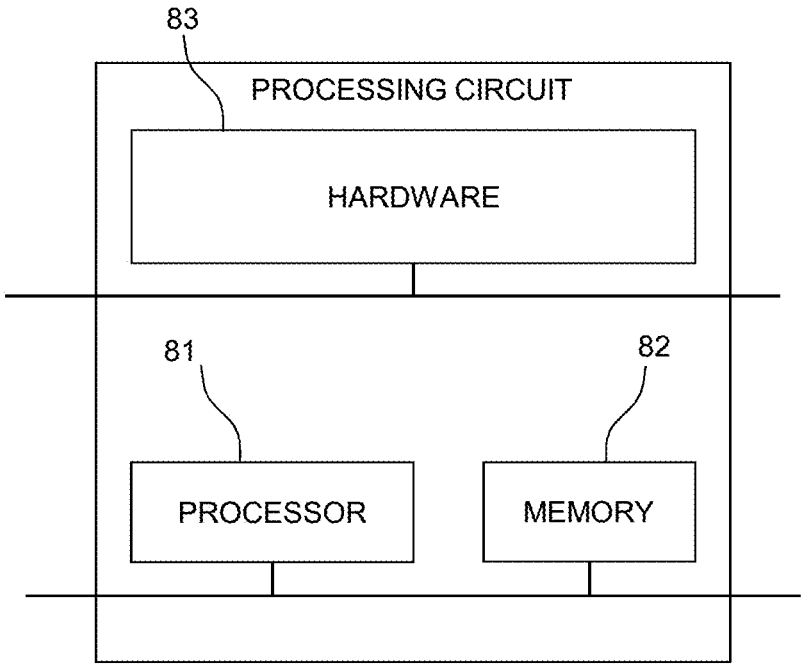
FIG. 7 is a conceptual diagram showing a hardware configuration example of a processing circuit of the edge drop control device in each of the embodiments.

FIG. 7 is a conceptual diagram showing a hardware configuration example of a processing circuit of the edge drop control device in each of the embodiments. Each of the units in the device (the low response actuator manipulated amount calculation unit 12, the high response actuator manipulated amount calculation unit 13, and the manipulated amount determination unit 14) represents a part of functions; and each of the functions is provided by a processing circuit. As one aspect, the processing circuit includes at least one processor 81 and at least one memory 82. As another aspect, the processing circuit includes at least one piece of dedicated hardware 83.

In a case where the processing circuit includes the processor 81 and the memory 82, each of the functions is provided by software, firmware, or a combination of the software and firmware. At least either the software or firmware is described as a program. At least either the software or firmware is stored in the memory 82. The processor 81 reads and executes a program stored in the memory 82, thereby providing each of the functions.

In a case where the processing circuit includes the dedicated hardware 83, the processing circuit is, for example, a single circuit, a composite circuit, a programmed processor, or a combination of them. Each of the functions is provided by the processing circuit.

Although the embodiments according to the present disclosure have been described above, the present disclosure is not limited to the above embodiments but can be practiced by various modifications without departing from the spirit of the present disclosure.

What is claimed is:

1. An edge drop control device, comprising:

low response actuators provided in a rolling stand that rolls a strip, including a first low response actuator and a second low response actuator, and making a different amount of change to each of roll gaps at edges of the strip according to a combination of operation of the first low response actuator based on a correction manipulated amount A and operation of the second low response actuator based on a correction manipulated amount B;

a high response actuator provided in the rolling stand, having a higher response than the first low response actuator and the second low response actuator, and making a same amount of change to each of the roll gaps at the edges of the strip based on a correction manipulated amount C;

an edge drop meter provided at least either upstream or downstream of the rolling stand and measuring an edge drop amount for each of the both edges of the strip; and a processor configured to:

calculate a calculated manipulated amount A_calc of the first low response actuator and a calculated manipulated amount B_calc of the second low response actuator for bringing a difference between the measured edge drop amount and a target amount close to zero without using the high response actuator;

calculate a calculated manipulated amount C_calc of the high response actuator for bringing a difference between the measured edge drop amount and the target amount to zero without using the low response actuators;

when a determination condition is established, output the calculated manipulated amount A_calc as the correction manipulated amount A to the first low response actuator and outputting the calculated manipulated amount B_calc as the correction manipulated amount B to the second low response actuator; and when the determination condition is not established, output the calculated manipulated amount C_calc as the correction manipulated amount C to the high response actuator.

2. The edge drop control device according to claim 1, wherein the processor is configured to:

when the determination condition is not established, output the calculated manipulated amount C_calc as the correction manipulated amount C to the high response actuator;

output a difference between an amount that corresponds to the calculated manipulated amount C_calc and the calculated manipulated amount A_calc as the correction manipulated amount A to the first low response actuator; and output a difference between an amount that corresponds to the calculated manipulated amount C_calc and the calculated manipulated amount B_calc as the correction manipulated amount B to the second low response actuator.

3. The edge drop control device according to claim 2, wherein the determination condition is established when the calculated manipulated amount A_calc and the calculated manipulated amount B_calc are within an allowable range, and the determination condition is not established when at least either the calculated manipulated amount A_calc or the calculated manipulated amount B_calc is out of the allowable range.

4. The edge drop control device according to claim 2, wherein the determination condition is established when the amount of change per unit time of a rolling speed of the rolling stand is within an allowable range, and the determination condition is not established when the amount of change per unit time of the rolling speed is out of the allowable range.

5. The edge drop control device according to claim 1, comprising:

a memory that stores a control map defining a relation between a rolling speed of the rolling stand and a regulated manipulated amount C_reg of the high response actuator, the regulated manipulated amount not causing a change in the edge drop amount of the strip at rolling speed change, wherein the calculated manipulated amount C_calc is a difference between two of the regulated manipulated amount C_reg, one being obtained from the control map at a present control timing and related to the rolling speed of the present control timing, another being obtained from the control map at a previous control timing, the determination condition is established when the amount of change per unit time of the rolling speed is within an allowable range, and the determination condition is not established when the amount of change per unit time of the rolling speed is out of the allowable range, and wherein the processor is configured to:

when the determination condition is not established, output the calculated manipulated amount A_calc as the correction manipulated amount A to the first low response actuator;

output the calculated manipulated amount B_calc as the correction manipulated amount B to the second low response actuator; and output the calculated manipulated amount C_calc as the correction manipulated amount C to the high response actuator.

* * * * *